United States Patent [19]

Blagov et al.

[11] 4,141,289

[45] Feb. 27, 1979

[54] APPARATUS FOR FORMING ROUND BUNDLES OF ROD-SHAPED ARTICLES

[76] Inventors: Evgeny E. Blagov, ulitsa Lermontova, 5; Anatoly I. Panteleev, prospekt Lenina, 35/29, kv. 17; Nikolai S. Dmitriev, ulitsa Pushkina, 28a, kv. 40, all of Elektrostal Moskovskoi oblasti, U.S.S.R.

[21] Appl. No.: 844,301

[22] Filed: Oct. 21, 1977

[51] Int. Cl.[2] ..... B30B 5/04

[52] U.S. Cl. ..... 100/212; 100/3

[58] Field of Search ..... 53/198 R; 100/2, 212, 100/1, 3, 234, 269 R, 7, 8

[56] References Cited

U.S. PATENT DOCUMENTS

| | | | |
|---|---|---|---|
| 987,740 | 3/1911 | Peterman | 100/212 |
| 3,427,959 | 2/1969 | Keil | 100/212 |
| 3,556,319 | 1/1971 | Holden | 100/2 UX |
| 3,871,288 | 3/1975 | White | 100/2 |
| 3,956,982 | 5/1976 | Hill | 100/212 |

FOREIGN PATENT DOCUMENTS

| | | | |
|---|---|---|---|
| 1358472 | 7/1974 | United Kingdom | 53/198 R |
| 391013 | 12/1973 | U.S.S.R. | 100/2 |

*Primary Examiner*—Billy J. Wilhite

*Attorney, Agent, or Firm*—Burgess, Ryan and Wayne

[57] ABSTRACT

The apparatus has a receptacle adapted to accommodate the articles, a pair of generally C-shaped bell cranks pivotally mounted on the framework and arranged symmetrically with respect to the vertical axis of the apparatus, each bell crank being pivotally connected with its respective actuator for being pivoted thereby, a device for shaping the bundle to a round shape, including as many flexible elements as there are the bell cranks, and guides. Each flexible element has its opposite ends attached to the different arms of the same bell crank and runs about its respective guide situated to that side of the axis of the apparatus, which is opposite to the position of the working arm of the same bell crank in the open position of the apparatus, so that at the closed position thereof the topmost point of the flexible elements at the area of their intersection, directly underlying the bundle, should be situated in direct proximity to the bottom of the receptacle.

1 Claim, 9 Drawing Figures

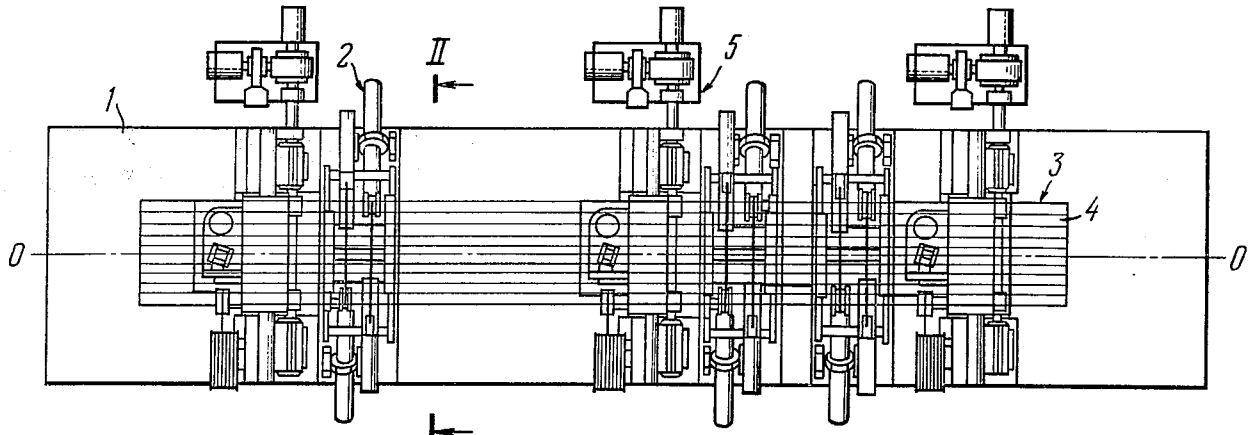
FIG.1
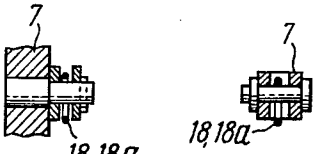
FIG.8
FIG.9
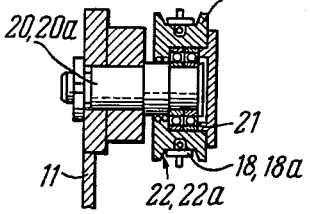
FIG.7
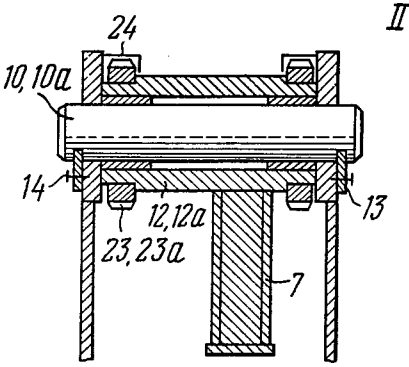
FIG.6

APPARATUS FOR FORMING ROUND BUNDLES OF ROD-SHAPED ARTICLES

The present invention relates to apparatus for forming round bundles or packs of rod-shaped articles. Apparatus of this type are widely utilized for bundling generally rod-shaped articles into a pack and retaining this pack while the latter is being either wrapped or tied up.

The apparatus of the present invention can be employed by various industries, including rolling mill production where it can be used as part of auxiliary equipment preparing rolled articles for shipment.

The present invention can be utilized to utmost effectiveness for forming round bundles of rod-shaped articles with relatively low cross-sectional area shaped as a circle, a square, a rectangle, etc., in combination with machines for tying up such bundles, wherein the mechanism for securing the ends of the tying-up material underlies the bundle. This arrangement of the mechanism securing the tying-up material enables to place the rod-shaped articles into the bundling apparatus without any obstruction and to remove ready bundles from this apparatus in any suitable known manner, while the mechanism for securing the ends of the tying-up material does not interfere in any way with the loading/unloading operations, and the machine for tying up the bundles is readily accessible for maintenance and other purposes.

The herein disclosed apparatus can be used in combination with practically every known bundle tying-up machine; likewise it can be used where bundles are tied up manually by means of hand-held pneumatic, electric and other tying tools.

However, the advantages offered by the presently disclosed apparatus can be utilized to their utmost in combination with tying-up machines where the coil or spool with the tying-up material is fixed on a rotatable rotor, and the tying-up material encircles the bundle being tied up upon rotation of this rotor. Machines of this last-mentioned type have been found to ensure, in comparison with other types of machines for tying up bundles with wire, the most firm tying-up of a bundle with several turns and a knot made in one of the turns. However, it should be born in mind that machines of this type require a steady position of the vertical axis of the bundle formed, lest the stability of their performance might be affected.

The herein disclosed device is generally intended for forming bundles having a circular shape in their cross-section, within a wide range of diameters of such bundles. As compared with bundles having other cross-sectional shapes, e.g. a trapeze, a square, etc., round bundles have been found to retain the shape they have acquired in the process of the bundling and tying-up in the most dependable manner, which can be explained by the fact that a circle has the smallest perimeter of all the geometric shapes having the same cross-sectional area.

There are known apparatus for forming bundles comprising a receptacle adapted to accomodate therein rod-shaped articles and levers symmetrically arranged with respect to the vertical geometric axis of the apparatus and pivotally mounted on the framework of the apparatus, or else comprising relatively movable prisms, each having recesses facing the axis of the apparatus, these recesses upon closing of the respective elements defining a pattern corresponding to the required shape of a bundle, e.g. a circle.

However, each pair of the movable elements of this type of the hitherto known apparatus is capable of forming a bundle of a single fixed diameter. Should it be necessary to form bundles of several diameters, the corresponding amount of the sets of the movable elements is required.

Besides, the apparatus of the aforementioned known type in some cases fail to shape a bundle of rod-shaped articles to a round shape, even when the diameter of the bundle is the same fixed one, on account of the articles of the nominally same cross-sectional size being manufactured with certain tolerances concerning this size. Therefore, with the movable elements being closed and defining the fixed cross-sectional size of pattern, various bundles with the same number of articles having the same nominal cross-section are liable to have different total cross-sectional areas. Consequently, the bundles are liable to become oval-shaped either vertically or horizontally, which more often than not results in weakening of their ties during handling and transportation.

The above listed disadvantages are practically non-existent in apparatus for forming round bundles of rod-shaped articles, wherein a bundle is shaped with aid of flexible elements.

Thus, there is known an apparatus for forming round bundles comprising a receptacle in the form of a housing with a recess therein, adapted to accomodate rod-shaped articles, a single C-shaped bell crank pivotally mounted on the housing of the receptacle, having its concave side facing the recess of the receptacle and also having one its arm connected to a drive or actuator for being pivoted thereby, and a device for shaping a bundle into a round shape. The device for shaping a bundle into a round shape has a flexible element having one end thereof secured to the housing of the receptacle and its other end secured to a driving drum, and an idle roller mounted on the working arm of the bell crank, the flexible element running about this idle roller. The pivot mounting the bell crank and the drum to which one end of the flexible member is secured are situated to one side of the recess of the receptacle, while the other end of the flexible element is secured, accordingly, at a point to the opposite side thereof.

A bundle is formed with the bell crank being pivoted and with the drum having one end of the flexible member secured thereto being rotated, to take up the excessive length of this element, so that the bundle being formed is lifted off the bottom of the receptacle and becomes suspended on the flexible element. This apparatus does not require readjustment or reassembling to form bundles of various diameters, although, depending on the actual diameter of the bundle, the position of the vertical axis of the latter varies, as does the bottommost level of the bundle relative to the bottom of the receptacle.

There is further known an apparatus for forming round bundles of generally rod-shaped articles, comprising a receptacle adapted to accommodate therein the articles, a pair of generally C-shaped working levers pivotally mounted on the framework of the apparatus and being symmetrically arranged with respect to the vertical axis thereof, the levers having their concave sides facing the axis of the apparatus and being connected with a drive adapted to rotate the levers; the apparatus further comprising a device for shaping a bundle to a round shape and a mechanism for timing the rotation of the levers.

The device for shaping a bundle to a round shape in this last-mentioned apparatus includes a flexible element having one end secured to one of the levers and the other end connected, respectively, to the other lever, and four idle rollers of which two are mounted on the respective working levers and the other two are mounted on auxiliary levers which in the process of forming a bundle are adapted to take up the excessive length of the flexible element running about the said idle rollers.

A bundle is formed with the working levers being driven toward each other and with the auxiliary levers being rotated to take up the excessive length of the flexible element, while the bundle being formed is lifted off the bottom of the receptacle and becomes suspended on the flexible element, which means that when bundles of different diameters are formed, the position of the bottommost level of the bundles varies, and the position of their vertical axis is unstable.

There is further known another apparatus for forming round bundles of rod-shaped articles, which is considered as the prior art of the present invention. The apparatus comprises a receptacle adapted to accommodate therein the articles to be formed into a bundle, a pair of single-arm levers symmetrically arranged with respect to the vertical geometric axis of the apparatus, a drive for rotating these levers, a device for shaping the bundle to a round shape and a mechanism for timing the rotation of the levers. The levers in this apparatus are generally C-shaped and have their concave sides facing the axis of the apparatus. The levers are pivotally mounted on the common pivot axle or pin supported by the framework and extending along the vertical geometric axis of the apparatus, the levers being operatively connected to their common drive through a mechanism for timing their rotation under the action of this drive. The device for shaping the bundle to a round shape is made in the form of a flexible element having one end thereof attached to the free end of one of the levers and the other end thereof secured to the similar end of the other lever.

A bundle is formed by the last-described apparatus with the levers being driven toward each other, while the flexible element is being moved by the motion of the levers and encloses the articles therein. The bundle is formed on the suspended flexible element. When bundles of different diameters are formed, their bottommost level would not stay in the same place, and the bundle being formed is lifted off the bottom of the receptacle. While being tied up, the bundle is likewise suspended on the flexible element and lacks a firm support, which results in displacement of its vertical axis in the course of the tying-up operation and affects the quality of the tying-up of the bundle. Besides, the range of the diameters of bundles that can be formed is relatively narrow.

It is an object of the present invention to provide an apparatus for forming round bundles of rod-shaped articles, which should enable to form bundles in a wide range of their diameters, so that the bundles should be at the same bottommost level, although being of different diameters.

It is another object of the present invention to provide an apparatus which, while forming bundles of various diameters and maintaining their permanent bottommost level, should provide for alignment of the respective vertical axes of the bundle and of the apparatus.

These and other objects are attained in an apparatus for forming round bundles or rod-shaped articles, comprising a receptacle adapted to accommodate therein the articles, at least one pair of generally C-shaped levers pivotally mounted on the framework of the apparatus and symmetrically arranged with respect to the vertical geometric axis thereof, having their concave sides facing the axis of the apparatus and being pivotally connected with a drive adapted to pivot the levers, a device for shaping the bundle into a round-shape and a mechanism for timing the pivoting of the levers, in which apparatus, in accordance with the present invention, the device for shaping the bundle into a round shape includes a plurality of flexible elements of which the number equals that of the levers which latter are of the double-arm or bell crank type, and guides situated to the opposite sides of the vertical axis of the apparatus, each flexible element having its ends secured to the different arms of the same respective bell crank and running about its respective guide situated to that side of the axis of the apparatus, which is opposite to the position of the working arm of this bell crank in the open state of the apparatus, so that with the apparatus closed, the topmost point of the flexible elements at the area of their intersection, directly underlying the bundle, should be in direct proximity to the bottom of the receptacle.

The present invention discloses an apparatus for forming round bundles of rod-shaped articles, enabling to form bundles in a wide range of their diameters, so that irrespectively of their diameters they have the same permanent bottommost level, the axis of the bundle being aligned with the axis of the apparatus, and the bundle itself being situated at the bottom of the receptacle, which enhances the quality of tying up of the bundles of rod-shaped articles, which is essential for their successive handling and transportation; furthermore, the invention creates prerequisites for automation of the operation of a plant for packaging rod-shaped articles, including the herein disclosed apparatus for forming round bundles of rod-shaped articles and machines for tying up such bundles.

The present invention will be further described in connection with an embodiment thereof, with reference being had to the accompanying drawings, wherein:

FIG. 1 is a general plan view of a plant for packaging generally rod-shaped articles, including an apparatus for forming round bundles of rod-shaped articles, embodying the invention;

FIG. 6 is a sectional view taken on line VI—VI of FIG. 2;

FIG. 7 is a sectional view taken on line VII—VII of FIG. 2;

FIG. 8 is a sectional view taken on line VIII—VIII of FIG. 2;

FIG. 9 is a sectional view taken on line IX—IX of FIG. 2.

Figure 2:
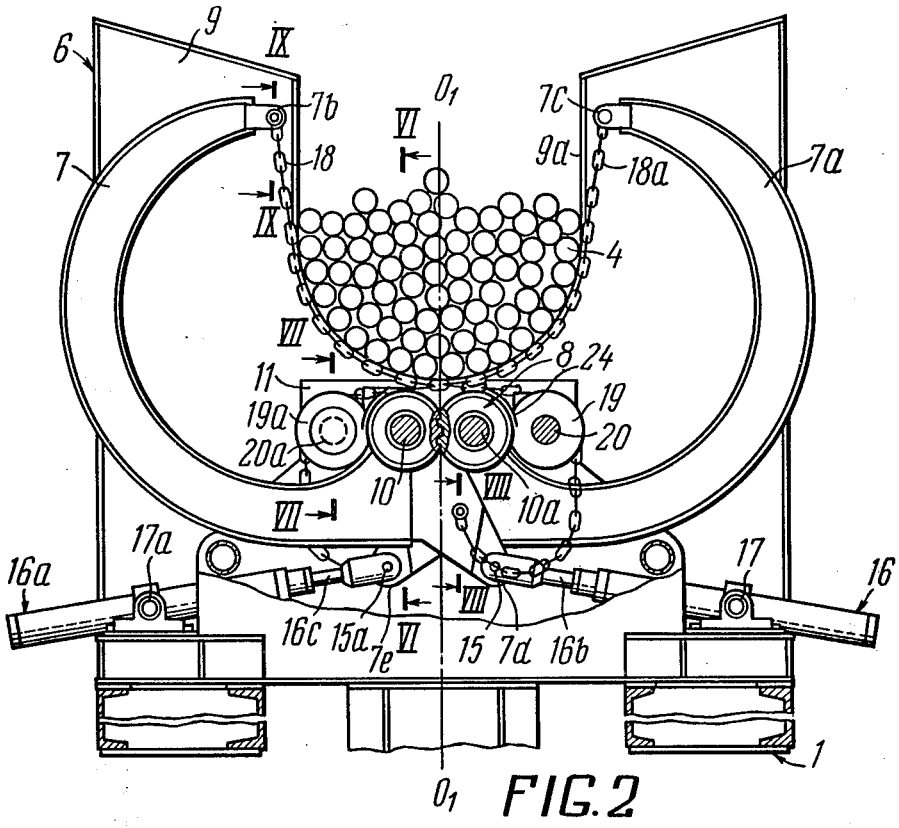
FIG. 2 is a sectional view taken on line II—II of FIG. 1, showing the apparatus for forming round bundles of rod-shaped articles, in accordance with the invention, in the open state of the apparatus, i.e. with the bell cranks spread to their endmost position.

In the drawings, the plant for packaging generally rod-shaped articles includes a common framework 1 (FIG. 1) having secured thereon in succession, along the axis 0—0 thereof, three apparatus 2 for forming round bundles 3 of rod-shaped articles 4 and three machines 5 for tying up the bundles 3 with wire, upon these bundles 3 having been formed by the apparatus 2 (it should be understood that the actual number of the apparatus 2 and machines 5 may vary in different plants for packaging rod-shaped articles, dependent as this number is on the length of the articles with which the plant is used and on the requirements put before tied up bundles. Similarly, the actual arrangement of the apparatus 2 and machines 5 on the framework 1 may likewise vary).

Each apparatus 2 (FIGS. 2, 3, 4) for forming round bundles 3 of rod-shaped articles 4 comprises a receptacle 6 adapted to accommodate the articles 4, a pair of double-arm levers or bell cranks 7 and **7*a* symmetrically mounted with respect to the vertical geometric axis 0,—0, of the apparatus 2, a device for shaping the bundle 3 into a round shape, and a mechanism 8 for timing the rotation of the bell cranks 7 and 7*a***.

The receptacle 6 adapted to accommodate the rod-shaped articles 4 is made in the form of a housing 9 fixed on the framework 1 and including a welded frame-like structure with a recess **9*a* having a semi-circular bottom (i.e. the bottom of the receptacle), the recess lying in a vertical plane perpendicular to the axis 0—0 of the framework 1. The rod-shaped articles 4 are loaded into the recess 9*a* (quite understandingly, the receptacle 6 may have various other structures, selected in each particular case to suit the conditions of the operation of the apparatus 2**).

The bell cranks 7 and **7*a* are pivotally mounted by means of respective axles 10 and 10*a* on the bed 11 rigidly fixed on the framework 1 and are generally C— or sickle-shaped, their concave sides facing the axis 0,—0, of the apparatus 2. The axles 10 and 10*a* on which the respective journals 12 and 12*a* of the bell cranks 7 and 7*a* are mounted symmetrically to opposite sides of the axis 0,—0, and are secured to the bed 11 by means of plates 13 (FIG. 6) and bolts 14**.

The bottom part of each arm 7 and **7*a* is pivotally (by means of pivots 15 and 15*a*, respectively) connected to the respective actuator or drive adapted to effect rotation of the arms. These actuators of the bell cranks 7 and 7*a* are made in the form of hydraulic cylinders 16 and 16*a* mounted for pivoting about pivot pins 17 and 17*a***, respectively.

The axle 10 pivotally supporting the bell crank 7 is mounted to one side of the vertical axis $0_1$—$0_1$ of the apparatus 2, while the pivot pin 17 pivotally supporting the hydraulic cylinder 16 actuating this bell crank 7 is mounted to the opposite side of the axis $0_1$—$0_1$. The relative arrangement of the axle **10*a* and the pivot pin 17*a*** with respect to the axis $0_1$—$0_1$ is similar to the one described.

Figure 5:
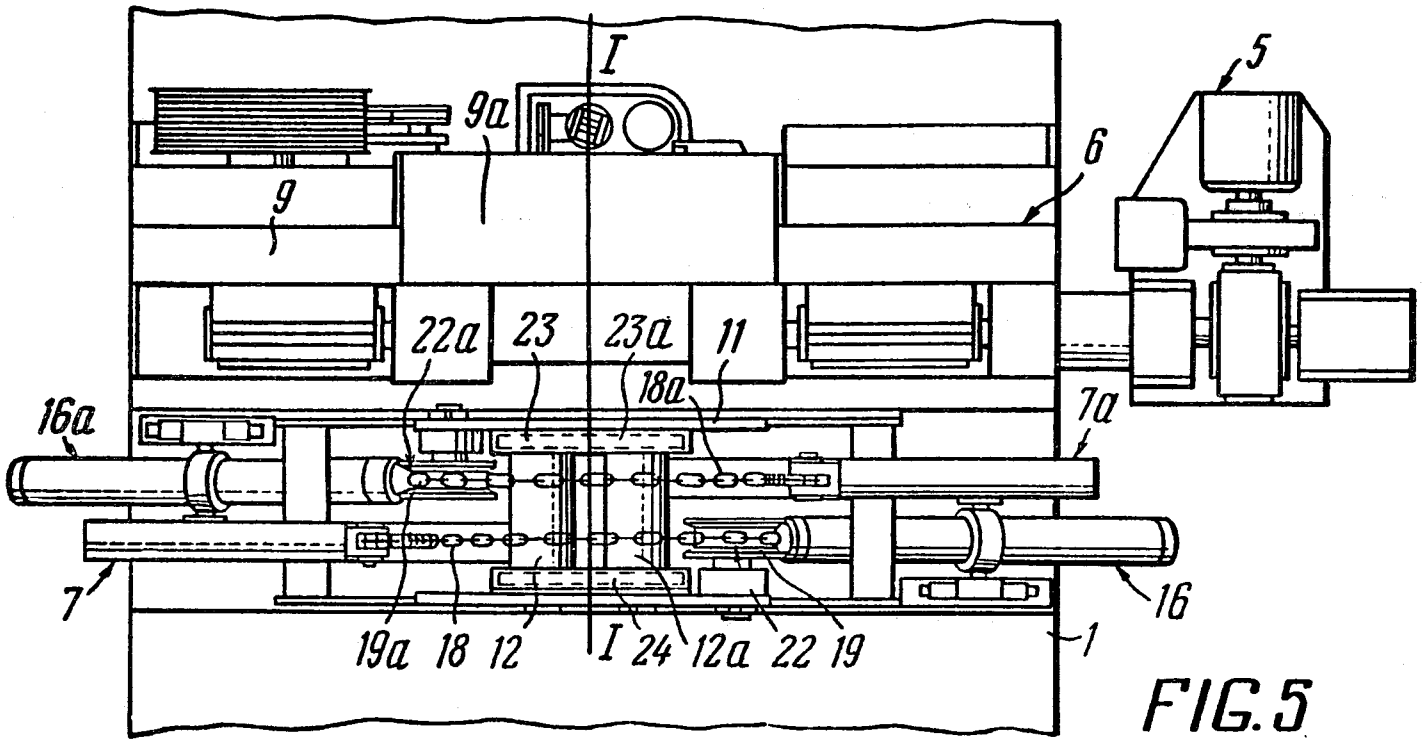
FIG. 5 is a plan view of the apparatus for forming round bundles of rod-shaped articles, in accordance with the invention.

The bell cranks 7 and **7*a* with their respective actuating cylinders 16 and 16*a*** are arranged, as it can be seen in FIG. 5, in parallel vertical planes.

The device for shaping the bundle 3 into a round shape is provided with two flexible elements — chains 18 and **18*a*, i.e. their number equals that of the bell cranks 7 and 7*a*, and guides 19 and 19*a* symmetrically arranged to opposite sides of the vertical axis $0_1$—$0_1$ of the apparatus 2**.

Each chain 18 and **18*a* is secured to the opposite ends of the same respective bell crank and runs about the respective guide 19 or 19*a* situated to that side of the axis $0_1$—$0_1$ of the apparatus 2 which is opposite to the respective working arm 7*b* or 7*c* of this respective bell crank 7 or 7*a* in the open state of the apparatus (when the bell cranks 7 and 7*a* are spread apart into their end-most positions), this open state being illustrated in FIG. 2 of the appended drawings. It can be seen in FIG. 2 that the chain 18 has one its end fixed to the arm 7*b* of the bell crank 7, runs about the guide 19 and has its opposite end fixed to the arm 7*d* of the same bell crank 7, while the chain 18*a* correspondingly has its ends fixed to the arms 7*c* and 7*e* of the bell crank 7*a* and runs about the guide 19*a***.

With the flexible elements being thus arranged and secured, the range of the diameters of bundles that can be formed is significantly broadened.

Thus, the chains 18 and **18*a* belong to different vertical plane and intersect in a direct proximity to the bottom of the receptacle 6 of the apparatus 2**.

In the presently described embodiment the guides 19 and **19*a* are made in the form of idle rollers or pulleys, supported, respectively, by arbors 20 and 20*a* and mounted in a cantilever fashion on the bed 11, each roller being rotatable about its respective arbor by means of a ball bearing 21 (FIG. 7), the rollers or pulleys 19 and 19*a* having trough-shaped peripheries 22 and 22*a* adapted to guide the respective chains 18 and 18*a* (it should be understood that the guides 19 and 19*a* may have a structure different from the one described. For the purposes of the present invention it is essential that the guides should be incorporated in the device for shaping a bundle into a round shape and that they should be arranged with respect to the vertical axis $0_1$—$0_1$ of the apparatus 2 and to the bottom of the receptacle 6** in the abovespecified general manner).

The rollers or pulleys 19 and **19*a* which in the presently described embodiment act as the guides, respectively, for the chains 18 and 18*a*, i.e. for the flexible elements, are arranged so that the topmost point of the chains 18 and 18*a* guided by the trough-shaped peripheries of the rollers 19 and 19*a*, at the area of intersection of these chains, is in direct proximity to the bottom of the receptacle 6**. Preferably this point is at one level with the bottom, but it should not be above the latter.

The abovedescribed arrangement of the flexible elements and of the guides ensures that in the process of shaping a bundle 3 by means of the flexible elements, i.e. of the guides 18 and **18*a*, this bundle 3 is not lifted off the bottom of the receptacle 6, and that the bundle is formed on a rigid support which in the presently described embodiment is the bottom of the receptacle 6. In this way the bundle being formed acquires, in addition to the round shape, a stable position in the apparatus and the alignment of its vertical axis with the axis $0_1$—$0_1$ of the apparatus, and when bundles of various diameters are formed, there is ensured the stability of the position of their bottommost level which would be always aligned with the level of the bottom of the receptacle 6**.

The incorporation of the mechanism 8 for timing the pivoting of the bell cranks 7 and **7*a* is essential to ensure that the chains 18 and 18***a* move identically throughout the operation of forming the bundle 3 and thus preclude displacement of the latter in a horizontal plane, whereby the vertical axis of the formed bundle 3 is always aligned with the axis $0_1$—$0_1$ of the apparatus 2. The timing mechanism in the presently described embodiment includes meshing pinions 23 and 23*a* mounted, respectively, on the hubs 12 and 12*a* of the bell cranks 7 and 7*a*. Two such pinions are fixed on each one of the hubs 12 and 12*a* (FIG. 6). Thus, two pinions 23 are mounted on the hub 12 of the bell crank 7, and two pinions 23*a* are mounted on the hub 12*a* of the bell crank 7*a*, the pinions 23 meshing with the respective pinions 23*a* (FIG. 5).

To prevent scale, that might fall off bundles 3 formed of rolled stock and other foreign matter getting onto the working surfaces of the pinions 23 and 23*a*, the latter are covered from above with hoods 24 (FIG. 6). It should be understood, however, that the mechanism for timing the pivoting of the bell cranks 7 and 7*a* may have a different structure, suitable for the purpose.

The presently disclosed apparatus is operated, as follows.

Rod-shaped articles 4 that are to be arranged into round bundles 3 are placed into the receptacle of the apparatus for forming a bundle, the articles 4 being accumulated between the chains 18 and 18*a*, as it can be seen in FIG. 2. With the required amount of the articles 4 placed into the receptacle 6, the respective hydraulic cylinders 16 and 16*a* of all the bundling apparatus 2 incorporated in the packaging plant are actuated simultaneously, whereby the rods 16*b* and 16*c* of the cylinders 16 and 16*a* of the apparatus 2 drive, respectively, the bell cranks 7 and 7*a*, so that their work-performing arms 7*b* and 7*c* are pivoted toward each other. Consequently, the chains 18 and 18*a* enclose the articles and intersect thereunder and thereabove in a vertical plane, forming a round bundle, while the excessive length of the 18 and 18*a* is taken up or pulled out by the arms 7*e* and 7*d*.

Owing to the incorporation of the mechanism 8 for timing the rotation of the bell cranks 7 and 7*a*, the latter are positively rotated through the same angle, even if the loads applied thereto are not equal, and if the cylinders 16 and 16*a* are actuated not in the very same instant. With the timing mechanisms incorporated, the chains 18 and 18*a* are likewise driven in a synchronized manner, whereby alignment of the vertical axis of the bundle 3 being formed is positively aligned with the vertical axis $0_1$—$0_1$ of the apparatus 2.

Figure 3:
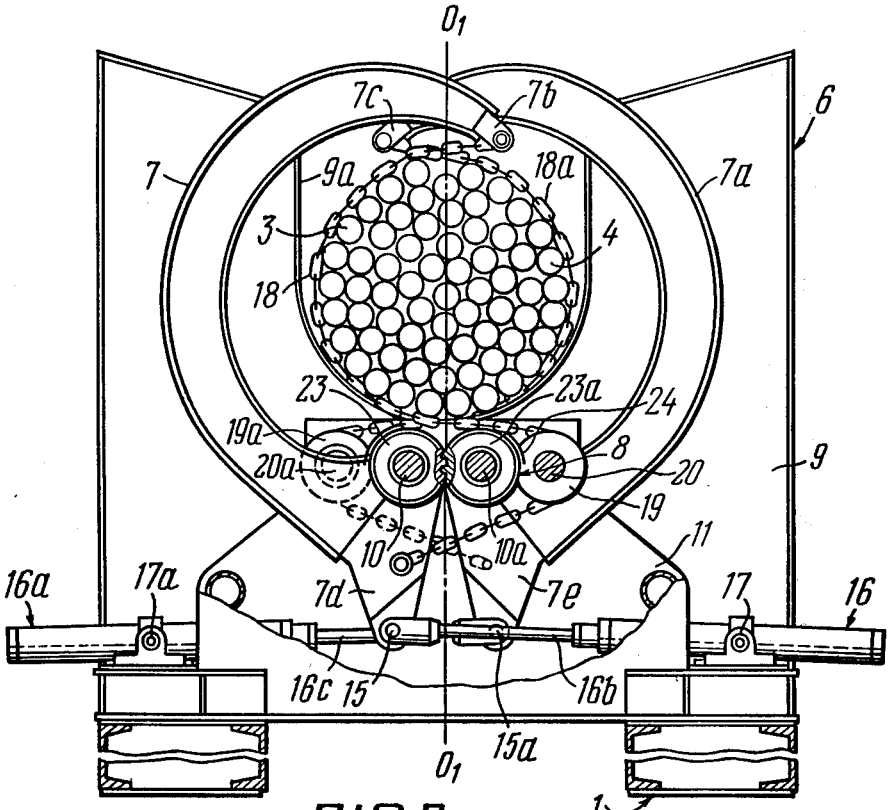
FIG. 3 is a view similar to FIG. 2, but with the bell cranks driven toward each other, a bundle of the maximum permissible size being formed, and the flexible elements encircling the bundle, shaping it into a round shape in cross-section.
Figure 4:
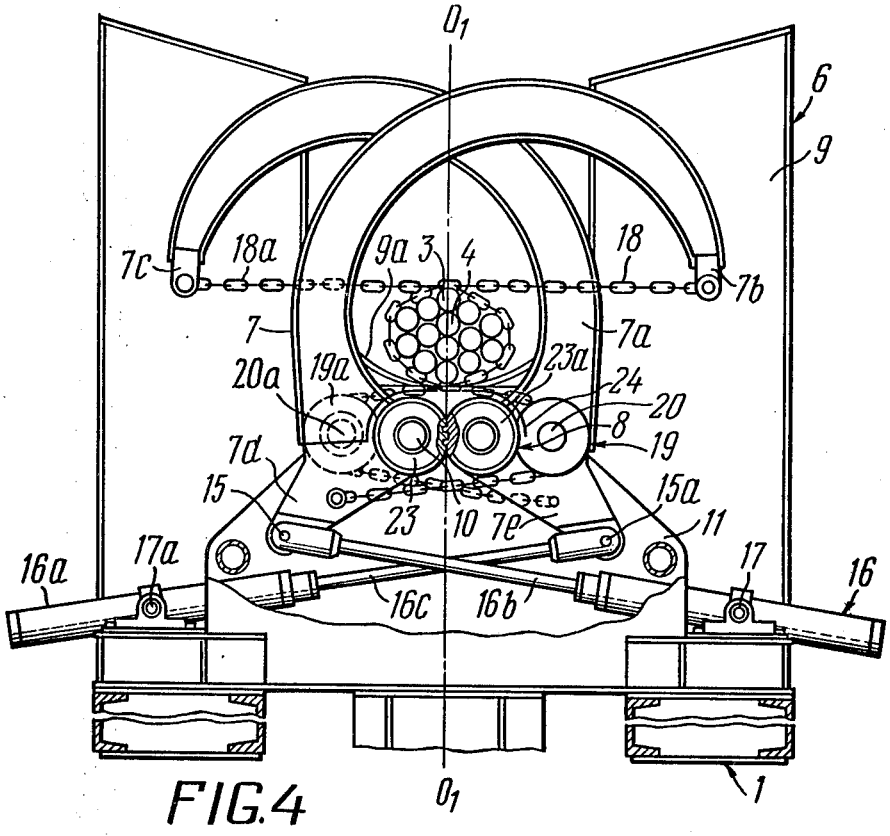
FIG. 4 shows the same as FIG. 3, but with a smaller bundle being formed.

Owing to the herein disclosed structure (FIG. 2) of the device for shaping the bundle 3 into a round shape, i.e. to the device including two flexible elements 18 and 18*a* (their number equalling that of the bell cranks 7 and 7*a*), with every flexible element 18 and 18*a* having its ends secured to the opposite arms 7*b*, 7*d* or 7*c*, 7*e* of the same respective bell crank 7 and 7*a* and running about its respective guide 19 or 19*a*, situated to the side of the vertical axis $0_1$—$0_1$ of the apparatus 2, opposite to the position of the working arm 7*b* or 7*c* of the respective bell crank 7 or 7*a* in the open state of the apparatus (shown in FIG. 2), with the apparatus being closed, the topmost point of the flexible elements 18 and 18*a* at the area of their intersection, directly underlying the bundle 3, is always in direct proximity to the bottom of the receptacle 6, and bundles 3 of different diameters are formed so that the bottommost level of the bundles is likewise positively in direct proximity to the bottom of the receptacle 6; in other words, the bundle 3 is always formed on a rigid support afforded by this bottom (FIGS. 3, 4).

With the bundle 3 thus formed, it lies on the bottom of the receptacle 6 and is retained in this position by the chains 18 and 18*a*, while the machine 5 is tying it up with wire.

Owing to the chains 18 and 18*a* being taut and firmly hugging the bundle 3, the axis of the latter is not displaced during the tying-up operation from the axis $0_1$—$0_1$.

With the bundle 3 having been tied up, the cylinders 16 and 16*a* are operated to retract their respective rods 16*b* and 16*c*, whereby the bell cranks 7 and 7*a* are spread apart, moving the chains 18 and 18*a* off the bundle 3, so that finally the arms 7*b* and 7*c* of the bell cranks 7 and 7*a* and the chains 18 and 18*a* are retracted beyond the confines of the recess 9*a* of the receptacle 6, i.e. they occupy their initial positions shown in FIG. 2.

What we claim is:

1. An apparatus for forming generally round bundles of rod-shaped articles, comprising: a framework; at least one pair of bell cranks with generally C-shaped working arms, pivotally mounted on said framework symmetrically with respect to a vertical geometric axis of the apparatus, the concave sides of said working arms facing the axis of the apparatus; drive means pivotally connected with said bell cranks for effecting pivoting of said bell cranks, a receptacle adapted to accommodate the articles to be packaged, said receptacle extending to both sides of the axis of said apparatus; a device for shaping a bundle of the articles into a generally round shape, including a plurality of flexible elements, their number equalling that of said bell cranks, and guides mounted on said framework at opposite sides of the vertical axis of said apparatus, each said flexible element having the ends thereof secured to the opposite arms of the same respective bell crank and running about a respective one of said guides, opposite to the position of the working arm of the respective one of said bell cranks in the open state of said apparatus, so that with said apparatus closed, the topmost point of said flexible elements at the area of intersection thereof directly underlying the bundle, is in direct proximity to the bottom of said receptacle; and means for timing the pivoting of said bell cranks, said timing means being symmetrically arranged with respect to the axis of said apparatus.

* * * * *